US005598932A

United States Patent [19]

Weidert

[11] Patent Number: 5,598,932

[45] Date of Patent: Feb. 4, 1997

[54] RACK FOR STORAGE OF FROZEN PIZZAS

[76] Inventor: Joseph Weidert, 124 N. Green Bay Rd., Appleton, Wis. 54911

[21] Appl. No.: 385,770

[22] Filed: Feb. 9, 1995

[51] Int. Cl.[6] ..... A47F 7/00

[52] U.S. Cl. ..... 211/41; 211/181

[58] Field of Search ..... 211/40, 41, 181; 206/449, 454, 521, 521.3

[56] References Cited

U.S. PATENT DOCUMENTS

| | | | |
|---|---|---|---|
| 1,888,141 | 11/1932 | Orth | 211/41 |
| 3,227,267 | 1/1966 | McBurney | 206/449 X |
| 4,813,543 | 3/1989 | Goldberg . | |
| 5,002,221 | 3/1991 | Ragan . | |
| 5,180,075 | 1/1993 | Montalbano . | |
| 5,191,977 | 3/1993 | Markovitz | 211/40 X |
| 5,199,577 | 4/1993 | Curtis | 211/41 X |
| 5,215,775 | 6/1993 | Hoffman, Jr. . | |
| 5,330,060 | 7/1994 | Bohner | 211/41 |
| 5,393,226 | 2/1995 | Groom | 211/41 X |

*Primary Examiner*—Robert W. Gibson, Jr.
*Attorney, Agent, or Firm*—Ryan, Maki, Mann & Hohenfeldt

[57] ABSTRACT

A rack for supporting frozen pizzas includes a structure having top, bottom, side and rear structural members with a frontal opening for insertion therein of horizontally oriented frozen pizzas. A plurality of vertically stacked supporting members are aligned in pairs and oriented parallel to the side walls of the structure, the members forming shelves providing surfaces for storage of pizzas in the rack. The top, bottom, side and rear walls may each be formed from a series of continuous horizontal members such as coated metal wire. The front members of the rack are spaced apart from each other at a wider distance sufficient to enable passage therebetween of a horizontally oriented frozen pizza than the side members, which are each spaced from each other a lesser distance, thereby forming members for supporting the frozen pizzas.

4 Claims, 2 Drawing Sheets

RACK FOR STORAGE OF FROZEN PIZZAS

FIELD OF THE INVENTION

The present invention relates to a rack for stacking of frozen foods such as pizzas for storage in a freezer compartment.

BACKGROUND OF THE INVENTION

The use of frozen pizzas for home consumption has expanded, and typically homeowners will store a number of frozen pizzas in a freezer compartment for future use. A problem with stacking of the packaged pizzas occurs due to the fact that they are somewhat convex in shape and, thus, will tend to fall out of a vertical stack. The pizzas can also be crushed by other food products in a freezer especially during removal of other products from the freezer which may cause crushing, falling, bending or breakage of the frozen pizza.

In view of the foregoing difficulties, a need has existed for an improved rack for storage of frozen pizzas within a freezer compartment.

SUMMARY OF THE INVENTION

The present invention as its principal object provides an improved rack for stacking a number of pizzas horizontally in a vertical stack within an upright freezer compartment and horizontally when hung in a chest-type freezer, while protecting them from being crushed or readily falling out of the compartment. The rack can also be attached to a freezer wall or hung on the opening of a chest type freezer to enable supporting of a number of frozen pizzas on edge, vertically. This arrangement is particularly advantageous in chest type freezers wherein use of the invention enables the pizzas to be supported near the top of the chest, thus avoiding stacking of other materials thereon.

The rack of this invention is preferably formed of coated wire members and is light weight and inexpensive. Alternatively, the invention provides a rack formed of sheet material such as plastic or coated paper materials.

Briefly, the invention provides a rack for supporting frozen pizzas which includes a structure having top, bottom, side and rear structural members with a frontal opening for insertion therein of horizontally oriented frozen pizzas. A plurality of vertically stacked supporting members are aligned in pairs and oriented parallel to the side walls of the structure, the members forming shelves providing surfaces for storage of pizzas in the rack. The top, bottom, side and rear walls may each be formed from a series of continuous horizontal members such as coated metal wire. The front members of the rack are spaced apart from each other at a wider distance sufficient to enable passage therebetween of a horizontally oriented frozen pizza than the side members, which are each spaced from each other a lesser distance, thereby forming members for supporting the frozen pizzas. The top member provides a means for supporting other food products above the pizzas while protecting the same from being crushed.

BRIEF DESCRIPTION OF THE DRAWINGS

Further aspects, objects and advantages of the invention will be set forth in the following detailed description, claims and accompanying drawings wherein:

DETAILED DESCRIPTION OF PREFERRED EMBODIMENTS

Figures 1, 2, 3:
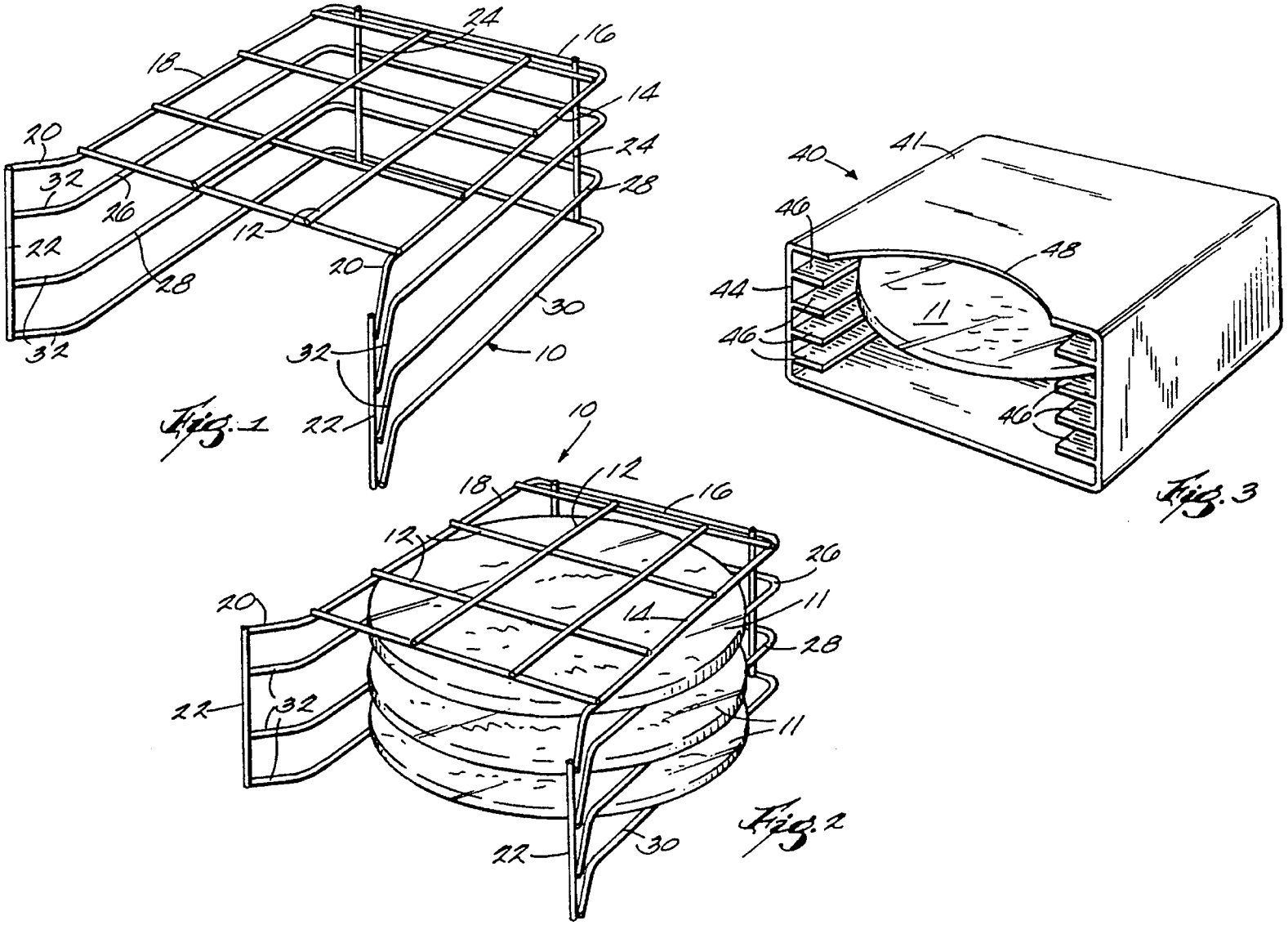
FIG. 1 is a perspective view of a preferred embodiment of the invention.
FIG. 2 is a perspective view showing a stack of pizzas supported in the rack of FIG. 1.
FIG. 3 is a perspective view showing an alternate embodiment of the invention.
Figure 4:
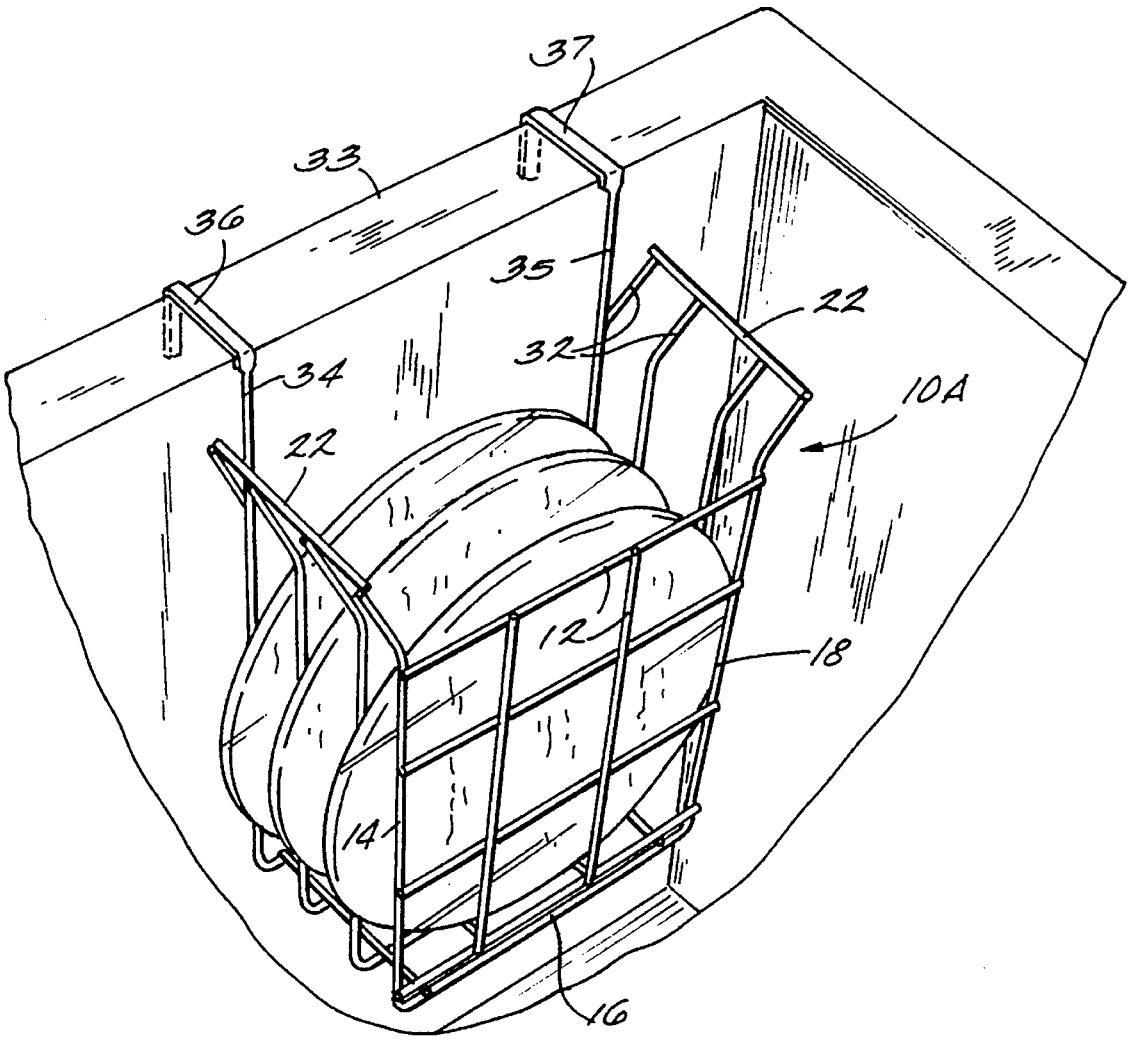
FIG. 4 is a perspective view showing a rack attached to the opening of a chest type freezer.

Referring more specifically to the drawings, a preferred rack 10 for supporting frozen pizzas 11 is illustrated in FIGS. 1, 2 and 4. Rack 10 includes a top structure 12 formed of interconnected stiff members oriented transversely to each other. The rack 10 is preferably formed of metallic wires coated with a heavy plastic coating but other materials of construction such as stiff plastics or the like can be substituted.

Rack 10 also includes a structure forming a perimeter around top portion 12 in the form of side members 14 and 18 and rear member 16 together with outwardly flaring front portions 20, which are preferably all formed from one piece of coated wire or similar material. A pair of upstanding members front members 22 are secured to the sides and form front edge members of rack 10. Preferably upstanding members 24 provide stability and a rear surface which limits the movement of pizzas 11 in the rack 10. Additional side and rear members 26, 28 and 30 are attached to and supported by upright members 22 and 24.

Each of the members 26, 28 and 30 include a flared forward portion 32 which provides an enlarged opening for insertion into the rack of a plurality of pizzas 11. As noted from FIG. 2, the flared forward opening represented by the distance between upright members 22 is sufficiently large to allow placement therein of each of the frozen pizzas 11, while the narrower space between the sides formed by members 14, 18, 24, 28 and 30 provide stable, level supporting surfaces for the packaged frozen pizzas 11.

In the alternative embodiment of the invention shown in FIG. 3, the alternate rack 40 is formed with closed top, bottom, side and rear walls 41, 42 and 44, respectively. If desired, the entire structure of rack 40 can be formed of molded plastic, fiberglass or the like. Alternatively, a plastic-coated, stiff, cardboard material can be utilized. The opposed side walls 44 are provided with inwardly projecting shelf-like projections 46, each of which is aligned with a corresponding projection on the opposed side at the same height. The two shelf-like projections together form a horizontal support for a single frozen pizza. It will, thus, be observed that a plurality of frozen packaged pizzas 11 can be stored within rack 40. It will be noted that the forward edge 48 of top 41 of rack 40 can be cut back or recessed as shown in FIG. 3 in order to provide easier access to the contents of the rack.

In practice, racks 10 or 40 are placed in an appropriate location in a freezer compartment and loaded with frozen pizzas which are then supported and easily removed for use without damage thereto. Top structures 12 or 41 provide a support for placement of other frozen foods over the pizzas 11 contained within the racks, as desired, without crushing forces being applied to the pizzas.

In FIG. 4 there is seen a modified rack 10A formed similarly to rack 10, discussed above. It will be seen that rack 10A can be attached to the opening of a chest type freezer 33, if desired. For that purpose support hangers 34 and 35 can be provided. Hangers 34 and 35 are provided with flattened hook ends 36 and 37, respectively, to provide a means for hanging rack 10A to the opening of freezer 33, as shown. Alternatively, rack 10 can be attached in similar fashion using strapping tape or the like. Such tape reduces any interference with the functioning of the door seal and also reduces the manufacturing cost of the rack.

The foregoing is considered as illustrative only of the principles of the invention, since numerous modifications and changes will be apparent to those skilled in the art. The invention, thus, should not be considered to be limited to the exact constructions shown and described. Accordingly, all suitable modifications and equivalents may be resorted to as falling within the true scope of the invention.

What is claimed is:

1. A rack for supporting frozen pizzas comprising a structure having top, bottom, side and rear structural members, said side and rear structural members being formed from a plurality of elongated rigid generally U-shaped members each in a horizontal plane and arranged in a vertically stacked relationship, an open side of said members forming a frontal opening for loading and unloading said rack, said structural members having first and second opposed sides, each of which are flared outwardly at an obtuse and toward said front opening and which terminate in ends at said frontal opening, first and second vertical supporting members being attached to said ends of said first and second opposed sides of each of said U-shaped members, at least one vertical supporting member attached to said U-shaped members and supporting the rear thereof, said frontal opening allowing for insertion between said first and second vertical supporting members of horizontally oriented frozen pizzas, said first and second opposed sides of said U-shaped members forming shelves providing surfaces for storage of pizzas in said rack.

2. A rack according to claim 1 wherein said walls are each formed from a series of continuous elongated members; said members all being connected to front and rear vertical supporting members;

said first and second vertical supporting members are spaced apart from each other a first distance sufficient to enable passage therebetween of a horizontally oriented frozen pizza and said side members are spaced from each other a second distance, less than said first distance, thereby forming said supporting shelves for supporting said frozen pizzas in a horizontal position.

3. A rack according to claim 2 wherein said elongated members comprise plastic coated metal wires.

4. A rack according to claim 1 wherein said top surface provides a support for frozen foods above the contents of the rack and prevents crushing forces from being applied to said contents.

* * * * *

UNITED STATES PATENT AND TRADEMARK OFFICE

CERTIFICATE OF CORRECTION

PATENT NO. : 5,598,932

DATED : February 4, 1997

INVENTOR(S) : Joseph Weidert

It is certified that error appears in the above-identified patent and that said Letters Patent is hereby corrected as shown below:

Column 3, Line 22 before "member" insert --- U-shaped ---

Column 3, Line 25 after "obtuse" delete "and" and substitute --- angle ---

Signed and Sealed this

Third Day of March, 1998

*Attest:*

*Attesting Officer*

BRUCE LEHMAN

*Commissioner of Patents and Trademarks*